US011312590B2

(12) United States Patent
Liao

(10) Patent No.: US 11,312,590 B2
(45) Date of Patent: Apr. 26, 2022

(54) AUTO-ADJUSTING PAPER SEPARATION MECHANISM

(71) Applicant: Foxlink Image Technology Co., Ltd., New Taipei (TW)

(72) Inventor: Wen Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 118 days.

(21) Appl. No.: 16/874,856

(22) Filed: May 15, 2020

(65) Prior Publication Data

US 2021/0261364 A1 Aug. 26, 2021

(30) Foreign Application Priority Data

Feb. 25, 2020 (TW) ..... 109202054

(51) Int. Cl.

| | |
|---|---|
| ***B65H 7/02*** | (2006.01) |
| ***B65H 3/28*** | (2006.01) |
| ***B65H 3/06*** | (2006.01) |
| ***B65H 7/18*** | (2006.01) |

(52) U.S. Cl.

CPC ..... *B65H 7/02* (2013.01); *B65H 3/0669* (2013.01); *B65H 3/28* (2013.01); *B65H 7/18* (2013.01); *B65H 2403/50* (2013.01); *B65H 2553/51* (2013.01)

(58) Field of Classification Search

CPC ..... B65H 3/06; B65H 3/0669; B65H 3/0684; B65H 7/00; B65H 7/02; B65H 7/18; B65H 7/20; B65H 2403/50; B65H 2553/51

See application file for complete search history.

(56) References Cited

U.S. PATENT DOCUMENTS

| | | | | |
|---|---|---|---|---|
| 4,753,433 | A * | 6/1988 | Rodi | B65H 5/24 271/151 |
| 2008/0237969 | A1* | 10/2008 | Totsuka | B65H 3/06 271/109 |
| 2011/0006469 | A1* | 1/2011 | Matsushima | B65H 7/02 271/121 |
| 2017/0166411 | A1* | 6/2017 | Kawarago | H04N 1/00631 |
| 2019/0193971 | A1* | 6/2019 | Nakajima | B65H 7/18 |
| 2019/0344985 | A1* | 11/2019 | Aoki | B65H 3/5261 |

FOREIGN PATENT DOCUMENTS

| | | | | |
|---|---|---|---|---|
| JP | 06171775 A * | 6/1994 | | B65H 3/06 |

* cited by examiner

*Primary Examiner* — Prasad V Gokhale
(74) *Attorney, Agent, or Firm* — Lin & Associates Intellectual Property, Inc.

(57) ABSTRACT

An auto-adjusting separation mechanism, comprising: a bracket with at least one side arm, a sensor module arranged on the side arm, a rotary shaft arranged at the front end of the bracket; a separation roller set pivotally arranged on the rotary shaft, a sensor wheel arranged to couple with the sensor module, and a torque limiter arranged at the front end of the bracket; wherein, by monitoring the rotation of the sensor wheel with the sensor module, the separating force of the separation roller set is adjustable via a microcontrollers which is capable to adjust the transmission gear set.

5 Claims, 8 Drawing Sheets

AUTO-ADJUSTING PAPER SEPARATION MECHANISM

CROSS-REFERENCE TO RELATED APPLICATION

The present application is based on, and claims priority from, Taiwan Patent Application No. 109202054, filed Feb. 25, 2020, the disclosure of which is hereby incorporated by reference herein in its entirety.

BACKGROUND OF THE INVENTION

1. Field of the Invention

The present invention relates to a paper separation mechanism, in particular to a paper separation mechanism which is able to adjust the settings of separating force automatically.

2. The Related Art

A conventional automatic document feeder using the separation roller to separate overlapped documents, and a conventional separation roller using the torque limiter to generate a separating force (F). As shown in FIG. 8, the separating force (F) equals to the torque (T) of the torque limiter divided by the radius (R) of the separation roller, and if the separation force (F) is greater than the friction between documents, the overlapped documents will be separated. However, if the torque (T) of the torque limiter is too large, the separation roller will be stuck and only wear out the specific area of the separation roller, only when the torque limiter and the normal force of the separation roller is matched so that the separation roller is able to separate documents and keep the separation roller durable.

The automatic document feeder is designed to transport variety documents with variety thickness, weight, and frictions. Therefore, the torque limiter and the separation roller are designed to be adjustable by users in accordance with the type of document.

However, the settings of the torque limiter and the separation roller are predetermined and difficult to respond to the immediate feeding situation, not to mention the user might not adjust the settings.

Therefore, it is necessary to provide a separation mechanism which is able to adjust the separation force automatically.

SUMMARY OF THE INVENTION

The objective of the present invention is to provide An auto-adjusting paper separation mechanism, comprising a bracket with two side arms; a sensor module arranged on one of the side arms; a rotary shaft arranged at a front end portion of the bracket; a separation roller assembly pivotally arranged on the rotary shaft; a sensor wheel connected with the separation roller assembly and arranged at one side of the separation roller assembly, the sensor wheel being corresponding to the sensor module, the sensor wheel and the separation roller assembly rotated together; a torque limiter arranged at the front end portion of the bracket and arranged at the other side of the separation roller assembly; and wherein, a microcontroller controls the torque limiter according to a rotation of the sensor wheel for adjusting a separating force of the separation roller assembly.

To achieve said objective, a transmission gear assembly is arranged at one side of a rear end portion of the bracket, the microcontroller controls the transmission gear assembly according to the rotation of the sensor wheel for adjusting the separating force of the separation roller assembly.

In a preferred embodiment, the bracket has a connecting portion, the side arms are arranged respectively on opposite sides of the connecting portion and perpendicular to the connecting portion, the rotary shaft is connected between front end portions of the side arms for being a rotating axis of the separation roller assembly, the sensor module is arranged on an outer surface of the one of the side arms, a rotary rod is arranged at a rear end portion of the bracket.

In a preferred embodiment, each of the side arms has a gap, the gap is formed at the front end portion of each of the side arms, two ends of the rotary shaft are secured in the gaps respectively, the one of the side arms further has a snapping portion, a positioning block, a positioning hole-, a limiting portion and an opening, the opening is formed on the one of the side arms, the snapping portion is extended from opposite sides of the opening, the positioning block is extended from the outer surface, the positioning hole is formed on the positioning block, and the limiting portion is hollowed from the outer surface.

In a preferred embodiment, the sensor module has a circuit board, a sensor component, a signal component, a through-hole and a screw bolt, a part of the circuit board is snapped in the snapping portion, the sensor component and the signal component are arranged on opposite ends of one side of the circuit board, the sensor component is encased in the snapping portion, the sensor component is aligned with the opening, the signal component is arranged in the limiting portion, the through-hole is formed on the circuit board, the through-hole is positioned between the sensor component and the signal component, the screw bolt is inserted in the positioning block and passed through the through-hole to be secured to the positioning hole.

In a preferred embodiment, the separation roller assembly has a plurality of separation rollers and a separation roller hub, the separation rollers are attached to the separation roller hub, a positioning portion is formed at one side of the separation roller hub, the sensor wheel is snapped at the positioning portion, the torque limiter is arranged at the other side of the separation roller hub and attached on the rotary shaft.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

In order to explain in detail, the technical content, structural features, objectives and effects of the present invention, the following is a detailed description with reference to the drawings.

Figure 1:
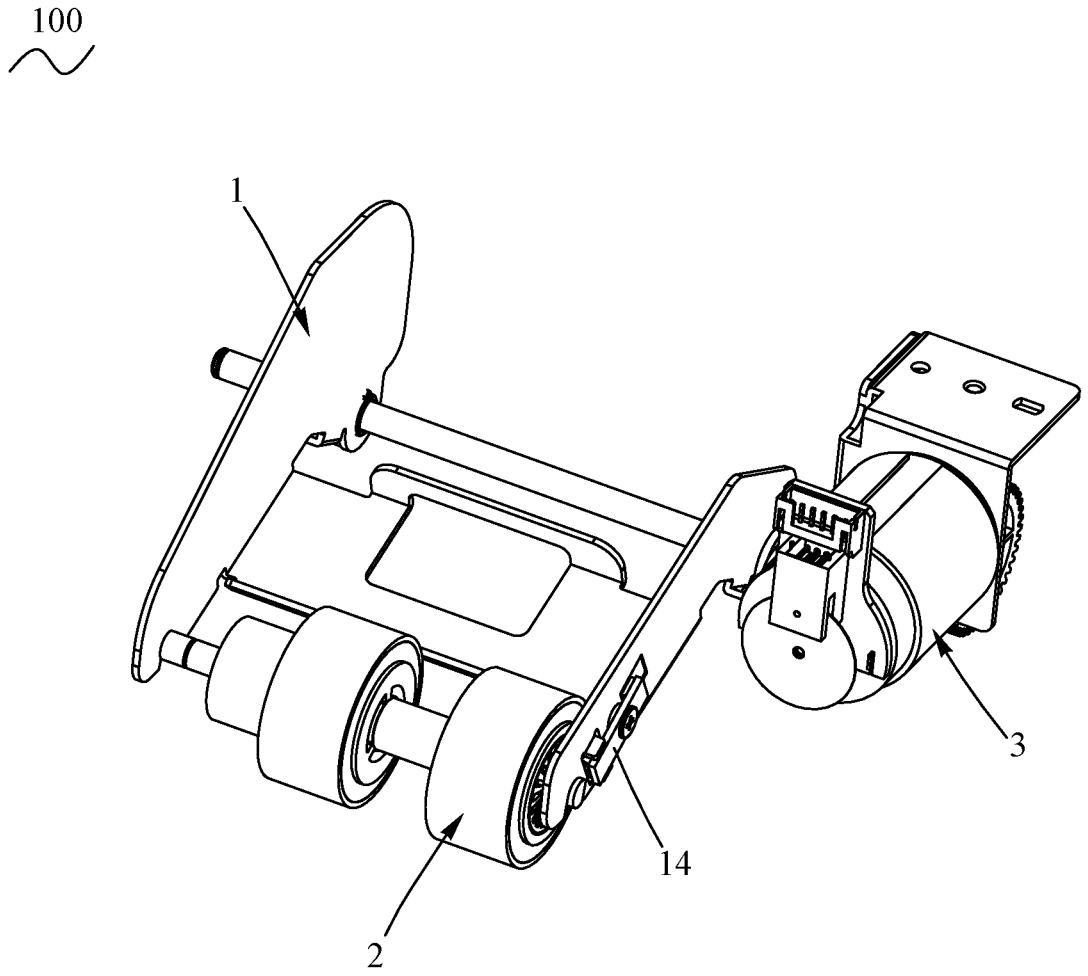
FIG. 1 is a perspective view of an auto-adjusting paper separation mechanism in this invention.
Figure 2:
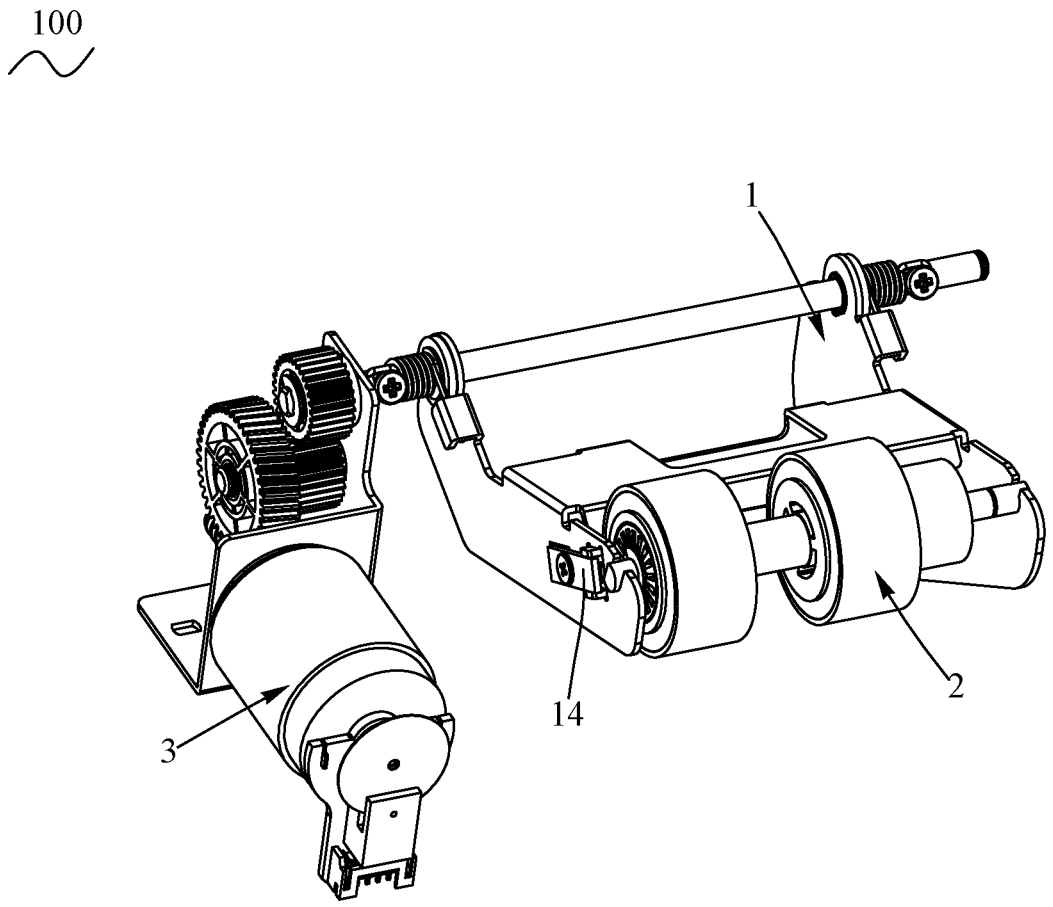
FIG. 2 is another perspective view of the auto-adjusting paper separation mechanism in this invention.

Referring to FIG. 1 and FIG. 2, the auto-adjusting paper separation mechanism 100 in this invention is arranged in an automatic document feeder (not shown) for preventing documents from being multi-fed. The auto-adjusting paper separation mechanism 100 includes a bracket 1, a separation roller assembly 2 and a transmission gear assembly 3. The separation roller assembly 2 is arranged at a front end portion of the bracket 1, the transmission gear assembly 3 is arranged at a side portion of the bracket 1.

Figure 3:
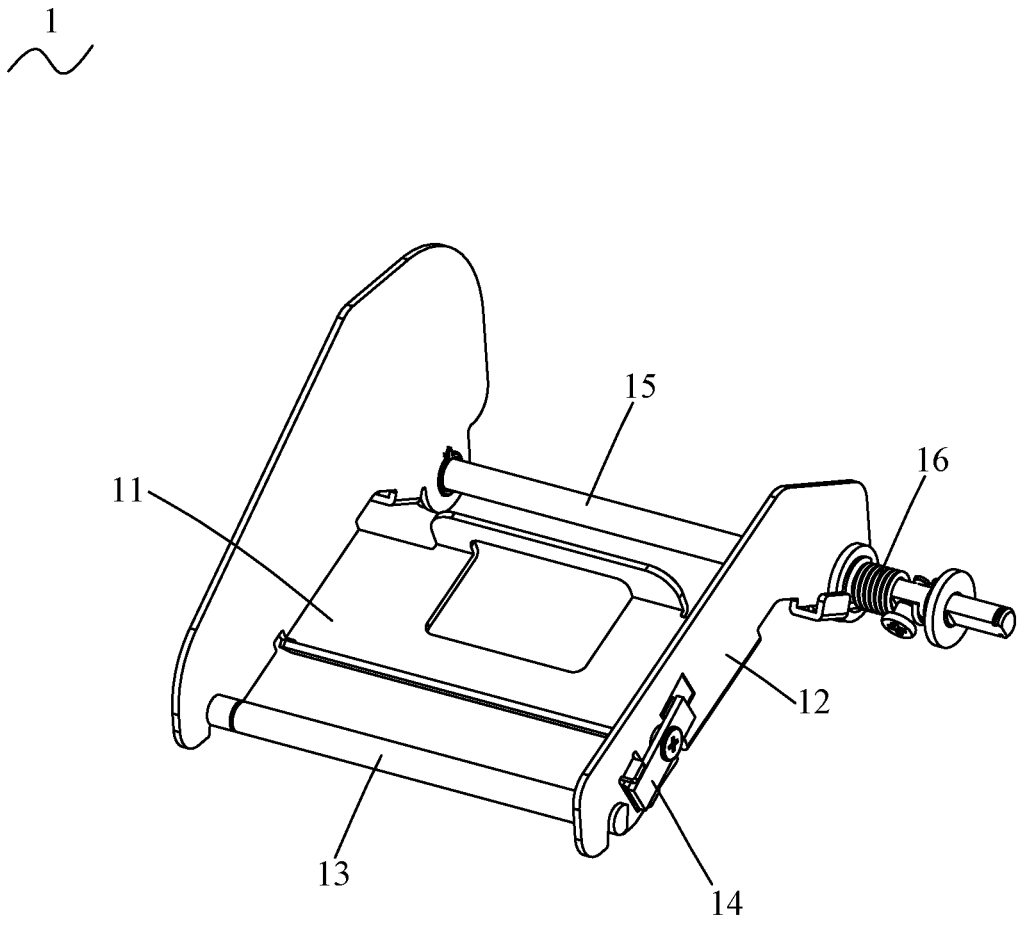
FIG. 3 is a perspective view of a bracket of the auto-adjusting paper separation mechanism in this invention.

Referring to FIG. 1 to FIG. 3, the bracket 1 includes a connecting portion 11, a pair of side arms 12, a rotary shaft 13, a sensor module 14, and a rotary rod 15. The side arms 12 are arranged on opposite sides of the connecting portion 11 and perpendicular to the connecting portion 11. The rotary shaft 13 is arranged at the front end portion of the bracket 1, the rotary shaft 13 is snapped to a corresponding structure of the side arm 12 and arranged between front end portions of two side arms, the rotary shaft 13 is connected between the front end portions of two side arms 12 for being a rotating axis of the separation roller assembly 2. The sensor module 14 is arranged on an outer surface of the side arm 12 for detecting the rotation of the separation roller assembly 2 which is used as a parameter for adjusting a separating force of the separation roller assembly 2 in the automatic document feeder. The rotary rod 15 is arranged at a rear end portion of the bracket 1, the rotary rod 15 is arranged between rear end portions of two side arms 12. One end of the rotary rod 15 is connected to the transmission gear assembly 3, both ends of the rotary rod 15 are arranged with a torsion spring 16. In this embodiment, when the transmission gear assembly 3 drives the rotary rod 15 to rotate counter-clock-wise in a view direction from the transmission gear assembly 3 toward the sensor module 14, a twist angle of torsion spring 16 is decreased and thus a normal force generated by the transmission gear assembly 3 is increased. When the transmission gear assembly 3 drives the rotary rod 15 to rotate clock-wise in a view direction from the transmission gear assembly 3 toward the sensor module 14, the twist angle of torsion spring 16 is increased and thus the normal force generated by the transmission gear assembly 3 is decreased. With the processes above, the separating force of the separation roller assembly 2 is adjustable in accordance to property of documents. To be more specific, the transmission gear assembly 3 is a solenoid.

Figure 4:
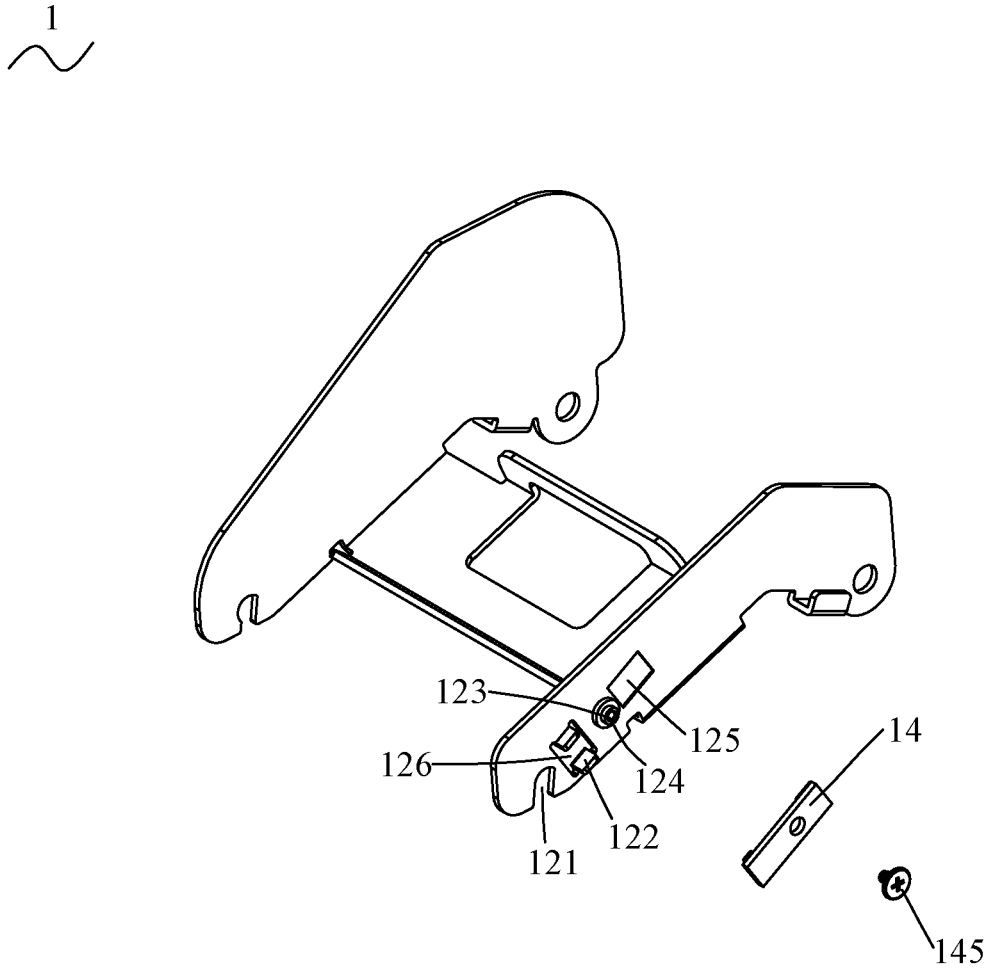
FIG. 4 is an exploded view of the bracket of the auto-adjusting paper separation mechanism in this invention.

Referring to FIG. 4, each of the side arms 12 comprises a gap 121, a snapping portion 122, a positioning block 123, a positioning hole 124 and a limiting portion 125. The gap 121 is formed at the front end portion of the side arm 12, two ends of the rotary shaft 13 are secured in the gaps 121 of the side arms 12. An opening 126 is formed on one of the side arms 12. The snapping portion 122 is extended from opposite sides of the opening 126. The sensor module 14 is snapped in the snapping portion 122 to be secured. The positioning block 123 is extended from the outer surface of the side arm 12. A corresponding structure of the sensor module 14 is snapped with the positioning block 123 to secured the sensor module 14 on the side arm 12. The positioning hole 124 is formed on the positioning block 123, a corresponding structure of the sensor module 14 is inserted in the positioning hole 124 to secured the sensor module 14 on the side arm 12. The limiting portion 125 is hollowed from the outer surface of the side arm 12, a corresponding structure of the sensor module 14 is arranged on the limiting portion 125.

Figure 5:
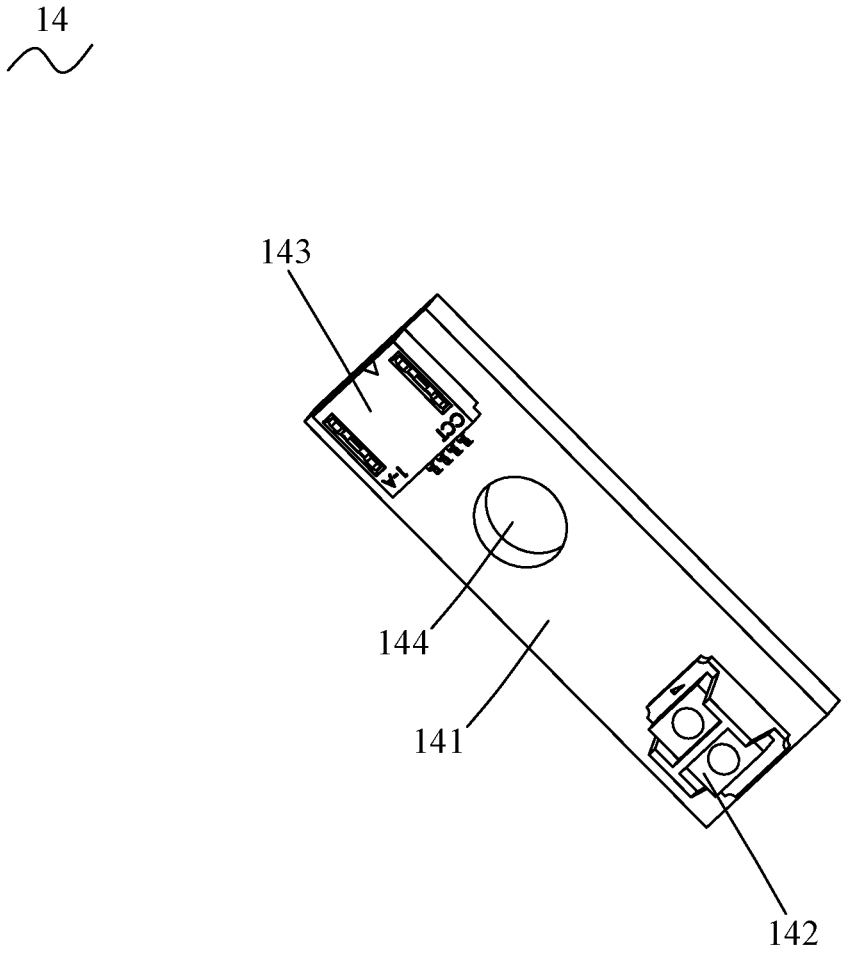
FIG. 5 is a perspective view of a sensor module of the auto-adjusting paper separation mechanism in this invention.

Referring to FIG. 5, the sensor module 14 comprises a circuit board 141, a sensor component 142, a signal component 143, a through-hole 144 and a screw bolt 145. A part of the circuit board 141 is snapped in the snapping portion 122 to secured the sensor module 14 on the outer surface of the side arm. The sensor component 142 and the signal component 143 are arranged on opposite ends of one side of the circuit board 141. The sensor component 142 is encased in the snapping portion 122 to monitor a corresponding structure of the separation roller assembly 2, the sensor component 142 is set in the opening 126. The signal component 143 is arranged in the limiting portion 125 to achieve the purpose of transmitting a signal generated from the sensor component 142. The through-hole 144 is formed on the circuit board 141, the through-hole 144 is positioned between the sensor component 142 and the signal component 143. The positioning block 123 is inserted in the through-hole 144 to secured the sensor module 14 to the side arm 12. The screw bolt 145 is inserted in the through-hole 144 to secured to the positioning hole 124.

Figure 6:
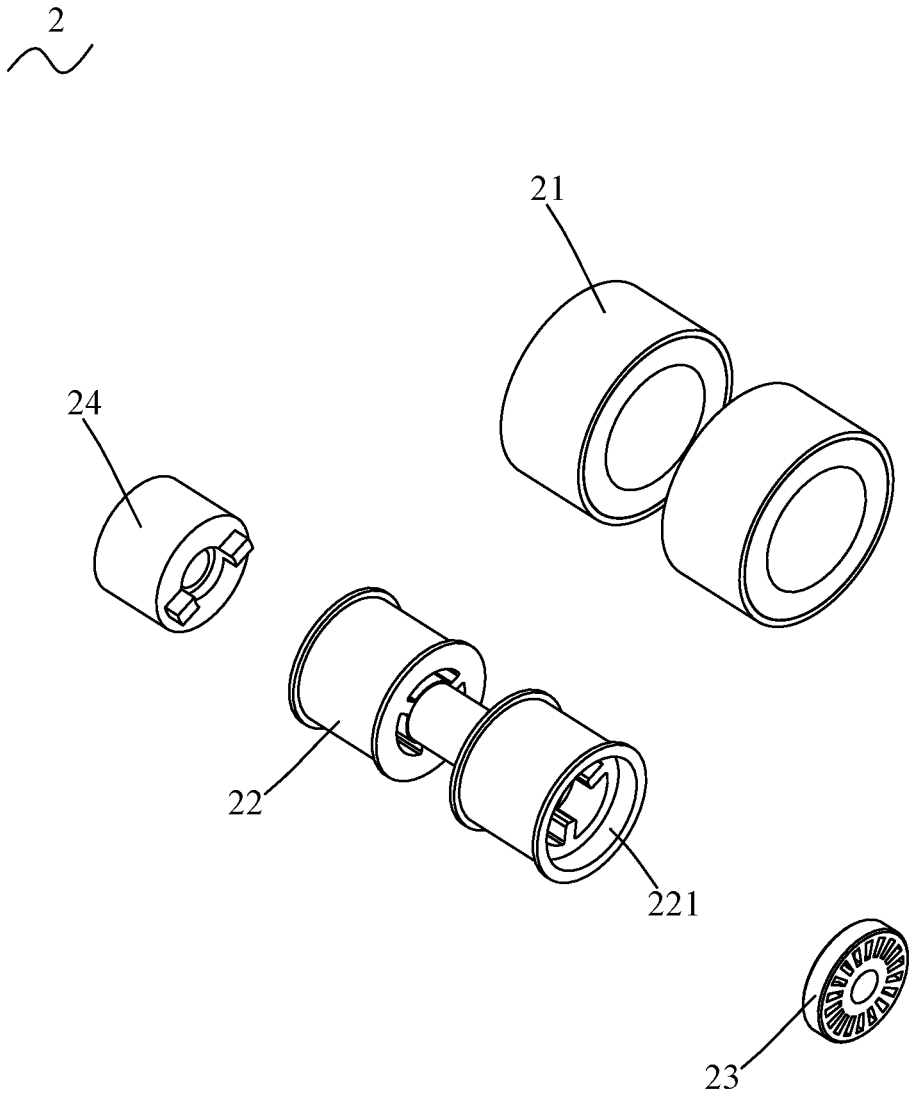
FIG. 6 is an exploded view of a separation roller assembly of the auto-adjusting paper separation mechanism in this invention.

Referring to FIG. 6, the separation roller assembly 2 comprises a plurality of separation rollers 21, a separation roller hub 22, a sensor wheel 23 and a torque limiter 24. The separation rollers 21 are attached to the separation roller hub 22, a positioning portion 221 is formed at one side of the separation roller hub 22. The sensor wheel 23 is snapped at the positioning portion 221. Therefore the sensor wheel 23 and the separation roller hub 22 are rotated together. The sensor module 14 measures an angular speed of the sensor wheel 23, the sensor module 14 is arranged to monitor the angular speed of the sensor wheel 23 through the opening 126 in order to adjust the separating force of the separation roller assembly 2 and optimize settings of the automatic document feeder and documents. The torque limiter 24 is arranged at the other end of the separation roller hub 22 and attached on the rotary shaft 13, the torque limiter 24 provides a torque (T) to the separation roller hub 22 for adjusting the separating force. The overlapped documents are separated when the separating force is greater than the friction between overlapped documents. To be specific, the torque limiter 24 is a hysteresis brake.

Figure 7:
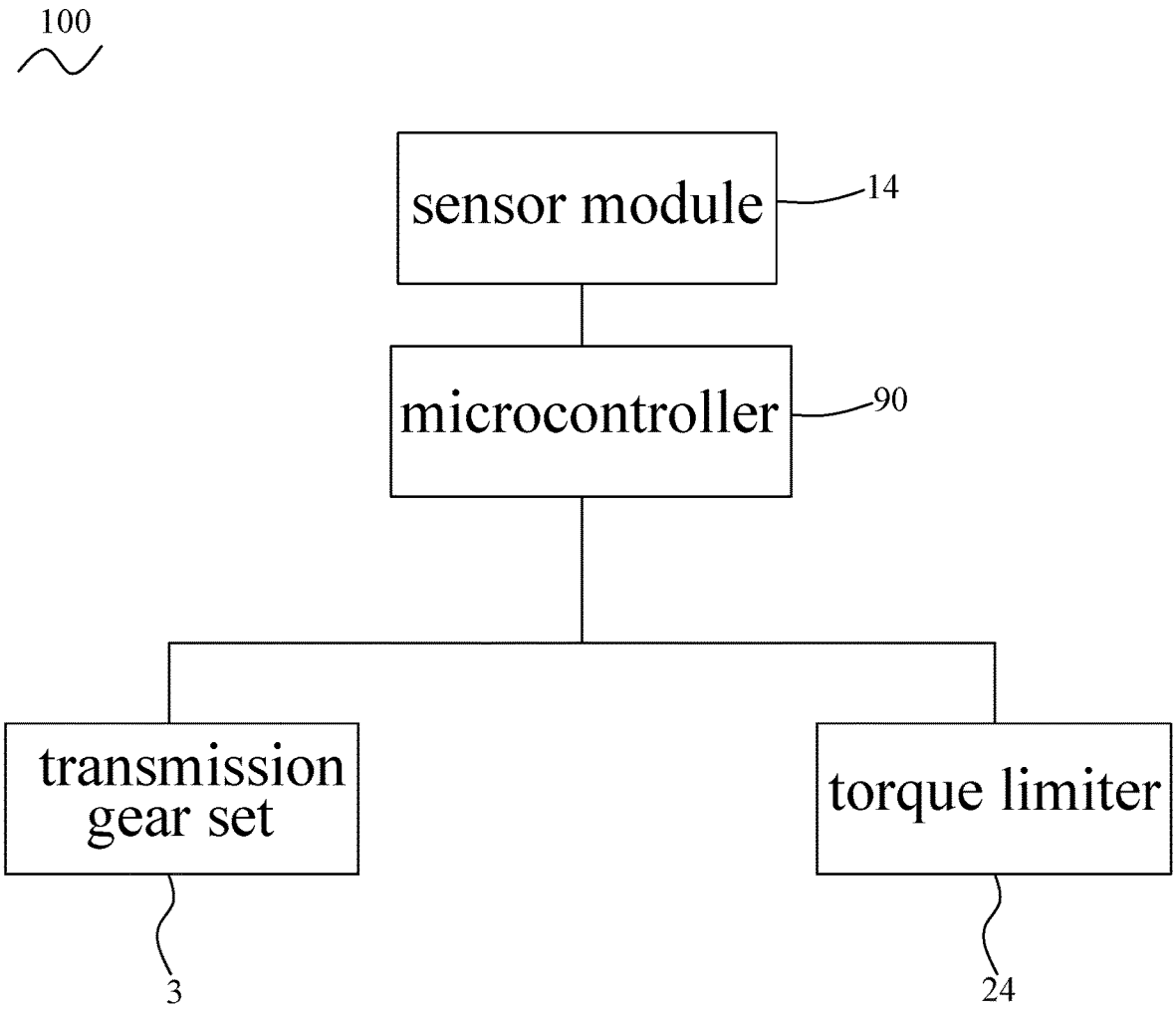
FIG. 7 is a block diagram of the auto-adjusting paper separation mechanism in this invention.
Figure 8:
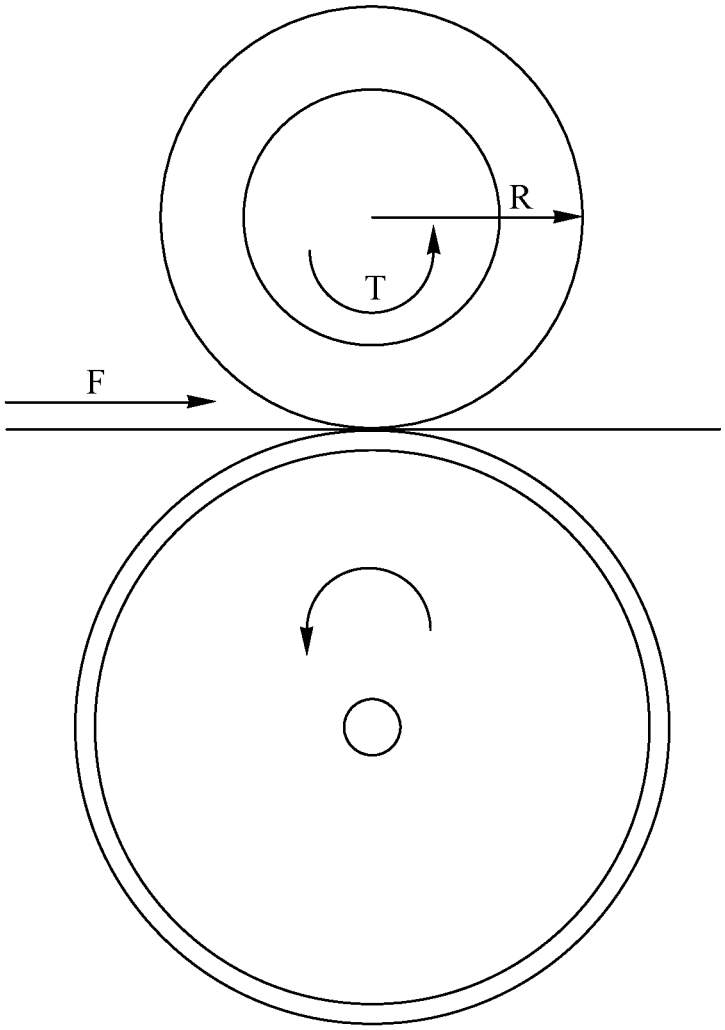
FIG. 8 is a schematic diagram of separating force in a conventional paper separation mechanism.

Referring to FIG. 7, by connecting a microcontroller 90 to the sensor module 14, the microcontroller 90 is connected with the transmission gear assembly 3 and/or the torque limiter 24 for adjusting the transmission gear assembly 3 and the torque limiter 24.

In conclusion, by detecting the rotation of the separation roller assembly 2 with the sensor module 14, and controlling the transmission gear assembly 3 and/or the torque limiter 24 via the microcontroller 90 which is able to adjust the transmission gear assembly 3 and the torque limiter 24, the auto-adjusting paper separation mechanism 100 in this invention adjusts the separating force of the separation roller assembly 2 to avoid wearing the specific area of the separation roller assembly 2 out and reducing the service life, and optimize settings of the auto-adjusting paper separation mechanism 100 to achieve the best separation effect and service life. Hence, the auto-adjusting paper separation mechanism 100 is capable to adjust the separating force automatically.

What is claimed is:

1. An auto-adjusting paper separation mechanism, comprising:

a bracket with two side arms;

a sensor module arranged on one of the side arms;

a rotary shaft arranged at a front end portion of the bracket;

a separation roller assembly pivotally arranged on the rotary shaft;

a sensor wheel connected with the separation roller assembly and arranged at one side of the separation roller assembly, the sensor wheel being corresponding to the sensor module, the sensor wheel and the separation roller assembly rotated together;

a torque limiter arranged at the front end portion of the bracket and arranged at the other side of the separation roller assembly; and wherein a transmission gear assembly is arranged at one side of a rear end portion of the bracket, and a microcontroller controls the torque limiter and the transmission gear assembly according to a rotation of the sensor wheel for adjusting a separating force of the separation roller assembly.

2. The auto-adjusting paper separation mechanism as claimed in claim 1, wherein the bracket has a connecting portion, the side arms are arranged respectively on opposite sides of the connecting portion and perpendicular to the connecting portion, the rotary shaft is connected between front end portions of the side arms for being a rotating axis of the separation roller assembly, the sensor module is arranged on an outer surface of the one of the side arms, and a rotary rod is arranged at the rear end portion of the bracket.

3. The auto-adjusting paper separation mechanism as claimed in claim 2, wherein each of the side arms has a gap, the gap is formed at the front end portion of each of the side arms, two ends of the rotary shaft are secured in the gaps respectively, the one of the side arms further has a snapping portion, a positioning block, a positioning hole, a limiting portion and an opening, the opening is formed on the one of the side arms, the snapping portion is extended from opposite sides of the opening, the positioning block is extended from the outer surface, the positioning hole is formed on the positioning block, and the limiting portion is hollowed from the outer surface.

4. The auto-adjusting paper separation mechanism as claimed in claim 3, wherein the sensor module has a circuit board, a sensor component, a signal component, a through-hole and a screw bolt, a part of the circuit board is snapped in the snapping portion, the sensor component and the signal component are arranged on opposite ends of one side of the circuit board, the sensor component is encased in the snapping portion, the sensor component is aligned with the opening, the signal component is arranged in the limiting portion, the through-hole is formed on the circuit board, the through-hole is positioned between the sensor component and the signal component, and the screw bolt is inserted in the positioning block and passed through the through-hole to be secured to the positioning hole.

5. The auto-adjusting paper separation mechanism as claimed in claim 2, wherein the separation roller assembly has a plurality of separation rollers and a separation roller hub, the separation rollers are attached to the separation roller hub, a positioning portion is formed at one side of the separation roller hub, the sensor wheel is snapped at the positioning portion, and the torque limiter is arranged at the other side of the separation roller hub and attached on the rotary shaft.

* * * * *